US011050176B2

(12) United States Patent
Yang et al.

(10) Patent No.: US 11,050,176 B2
(45) Date of Patent: Jun. 29, 2021

(54) ELECTRICAL CONNECTOR WITH THEREIN EMBEDDED GROUNDING BAR SECURED BY CONDUCTIVE ADHESIVE AND METHOD OF MAKING THE SAME

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: Chun-Chieh Yang, New Taipei (TW); Hsiu-Yuan Hsu, New Taipei (TW); Shih-Wei Hsiao, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/729,526

(22) Filed: Dec. 30, 2019

(65) Prior Publication Data

US 2020/0212612 A1 Jul. 2, 2020

(30) Foreign Application Priority Data

Dec. 29, 2018 (CN) ..... 201811634070.7

(51) Int. Cl.
*H01R 13/15* (2006.01)
*H01R 12/77* (2011.01)
(Continued)

(52) U.S. Cl.
CPC ..... *H01R 12/775* (2013.01); *H01R 12/62* (2013.01); *H01R 12/716* (2013.01); *H01R 13/15* (2013.01);
(Continued)

(58) Field of Classification Search
CPC .. H01R 13/6588; H01R 13/15; H01R 12/724; H01R 4/04; H01R 12/728; H01R 12/62;
(Continued)

(56) References Cited

U.S. PATENT DOCUMENTS 8,944,849 B1 * 2/2015 Yang ..... H01R 13/6588 439/607.07
9,281,589 B2 * 3/2016 Hsiao ..... H01R 4/04
9,337,585 B1 * 5/2016 Yang ..... H01R 13/6471

FOREIGN PATENT DOCUMENTS

CN 203813128 U 9/2014

* cited by examiner

*Primary Examiner* — Tho D Ta
(74) *Attorney, Agent, or Firm* — Ming Chieh Chang; Wei Te Chung

(57) ABSTRACT

An electrical connector with a contact module includes an insulative body, a plurality of contacts retained to the body, and a grounding bar embedded within the body. The contacts include a plurality of differential pair contacts and a plurality of grounding contacts. The ground bar forms a plurality of spring tangs. The body forms a plurality of cavities and the corresponding spring tangs of the grounding bar extend into the corresponding cavities to contact the corresponding grounding contacts. Conductive adhesive is filled within each cavity and solidified to secure all the spring tang, the corresponding grounding contact and the body together. The electrical connector is formed by a pair of contact modules back to back secured to together by an insulative case either by assembling or via an over-molding process. The cavities and the corresponding conductive adhesive of each contact module is hidden from the exterior.

20 Claims, 10 Drawing Sheets

(51) Int. Cl.

| | |
|---|---|
| ***H01R 43/02*** | (2006.01) |
| ***H01R 13/405*** | (2006.01) |
| ***H01R 12/71*** | (2011.01) |
| ***H01R 13/6471*** | (2011.01) |
| ***H01R 12/62*** | (2011.01) |
| ***H01R 13/6585*** | (2011.01) |
| *H01R 12/72* | (2011.01) |
| *H01R 4/04* | (2006.01) |
| *H01R 13/6588* | (2011.01) |

(52) U.S. Cl.
CPC ..... *H01R 13/405* (2013.01); *H01R 13/6471* (2013.01); *H01R 13/6585* (2013.01); *H01R 43/02* (2013.01); *H01R 4/04* (2013.01); *H01R 12/724* (2013.01); *H01R 13/6588* (2013.01)

(58) Field of Classification Search
CPC ..... H01R 12/716; H01R 13/405; H01R 13/6471; H01R 13/6585; H01R 43/02
See application file for complete search history.

ELECTRICAL CONNECTOR WITH THEREIN EMBEDDED GROUNDING BAR SECURED BY CONDUCTIVE ADHESIVE AND METHOD OF MAKING THE SAME

BACKGROUND OF THE DISCLOSURE

1. Field of the Disclosure

The present invention relates to an electrical connector, and particular to the electrical connector equipped with an embedded grounding bar secured by conductive adhesive.

2. Description of Related Arts

China Patent No. CN203813128U discloses an electrical connector forms a plurality of through hole extend through a plurality of grounding sheets and filled with conductive adhesive for electrical unification consideration. Anyhow, because the grounding sheet requires to form corresponding hole in alignment with those through hole for moving of liquid adhesive, there is less engagement area between the conductive adhesive and the corresponding grounding sheet, thus lessening the mechanical and electrical connection between the conductive adhesive and the grounding sheet in advantageously.

An improved electrical connector having a reliable mechanical and electrical connection between the conductive adhesive and the grounding part is desired.

SUMMARY OF THE DISCLOSURE

Accordingly, an object of the present disclosure is to provide an electrical connector with a contact module having an insulative body, a plurality of contacts retained to the body, and a grounding bar embedded within the body. The contacts include a plurality of differential pair contacts and a plurality of grounding contacts. The ground bar forms a plurality of spring tangs. The body forms a plurality of cavities and the corresponding spring tangs of the grounding bar extend into the corresponding cavities to contact the corresponding grounding contacts. Conductive adhesive is filled within each cavity and solidified to secure all the spring tang, the corresponding grounding contact and the body together. The electrical connector is formed by a pair of contact modules back to back secured to together by an insulative case either by assembling or via an over-molding process. The cavities and the corresponding conductive adhesive of each contact module is hidden from the exterior.

A method of making the aforementioned electrical connector includes the steps as follow: providing a first contact module with a first insulator integrally formed with a plurality of first contacts and a second contact module with a second insulator integrally formed with a plurality of second contacts wherein each of said first insulator and said second insulator includes a plurality of cavities to expose the corresponding grounding contacts, respectively; providing a grounding bar sandwiched between the first contact module and the second contact module wherein the grounding tangs of the grounding bar extend into and contact the corresponding grounding contacts, respectively; filling conductive adhesive into the corresponding cavities and solidifying the conductive adhesive to secure the grounding tangs and the grounding contacts in the cavities; and applying an insulative case upon the pair of contact modules to commonly form the finalized electrical connector.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

An electrical connector 100 for mounting to a printed circuit board (not shown) and mating to a complementary connector (not shown), includes an elongated insulative housing with a plurality of contacts secured thereto, and a metallic grounding bar embedded within the insulative housing and securing the grounding bar with the corresponding grounding contacts for performing the grounding effect.

Figure 1:
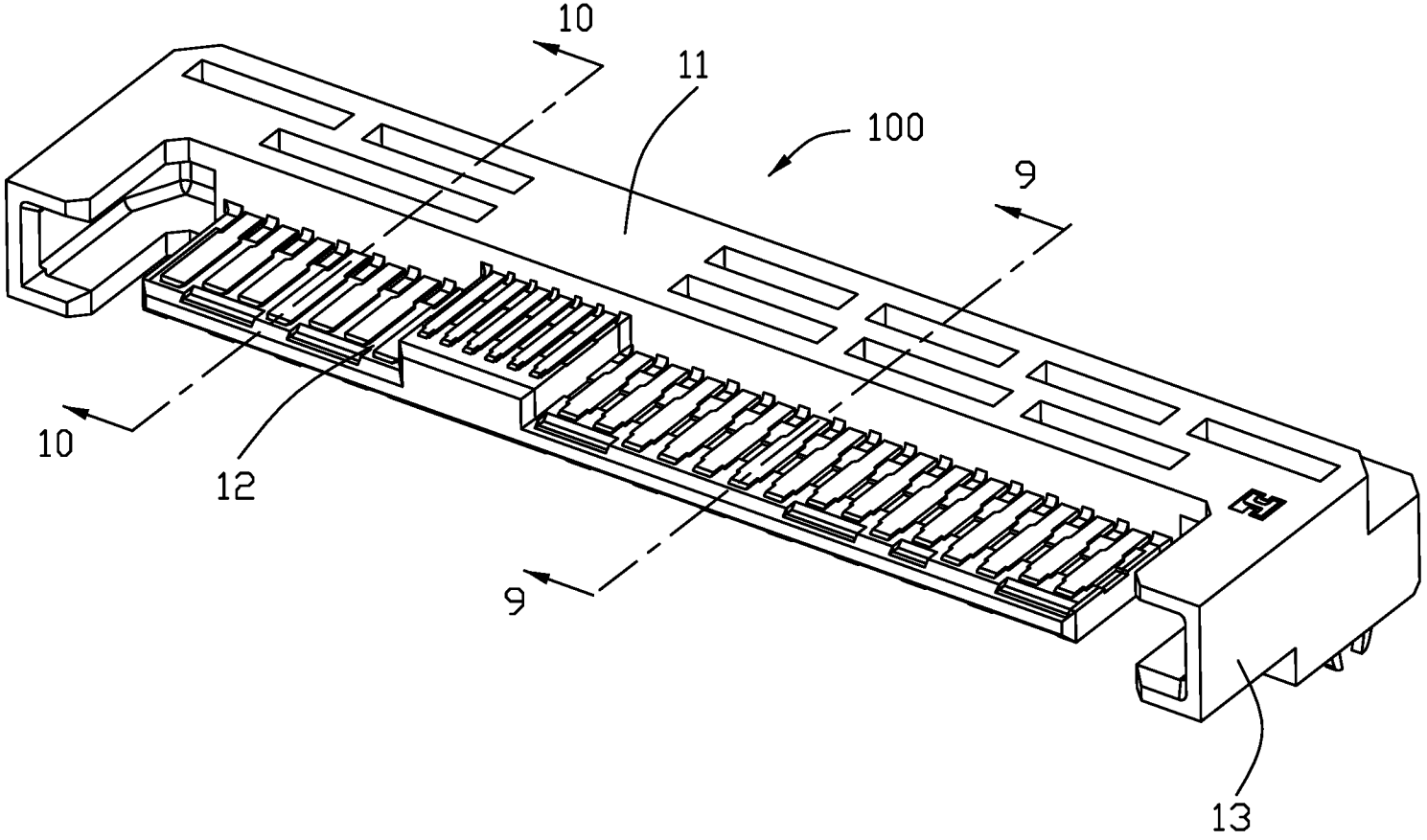
FIG. 1 is a perspective view of an electrical connector according to the invention.
Figure 2:
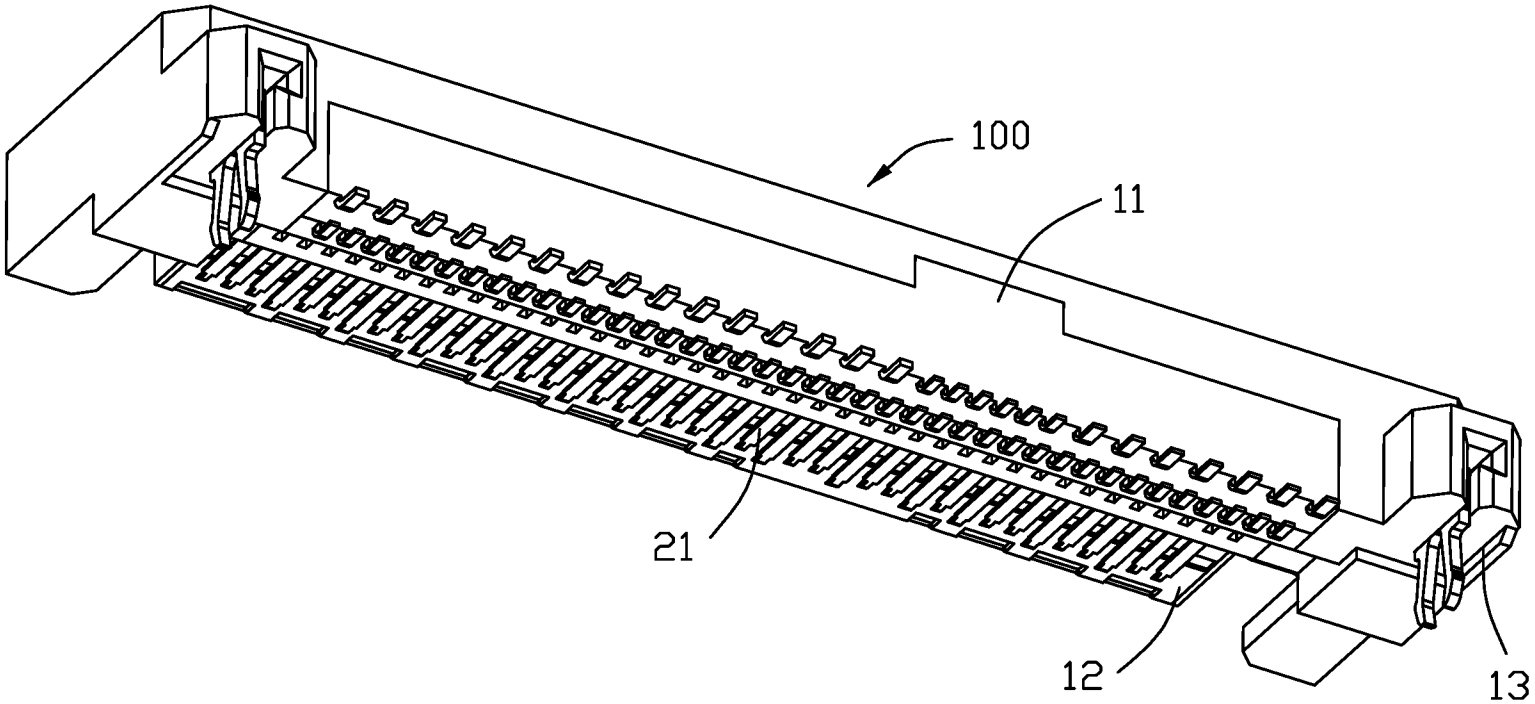
FIG. 2 is another perspective view of the electrical connector of FIG. 1.
Figure 3:
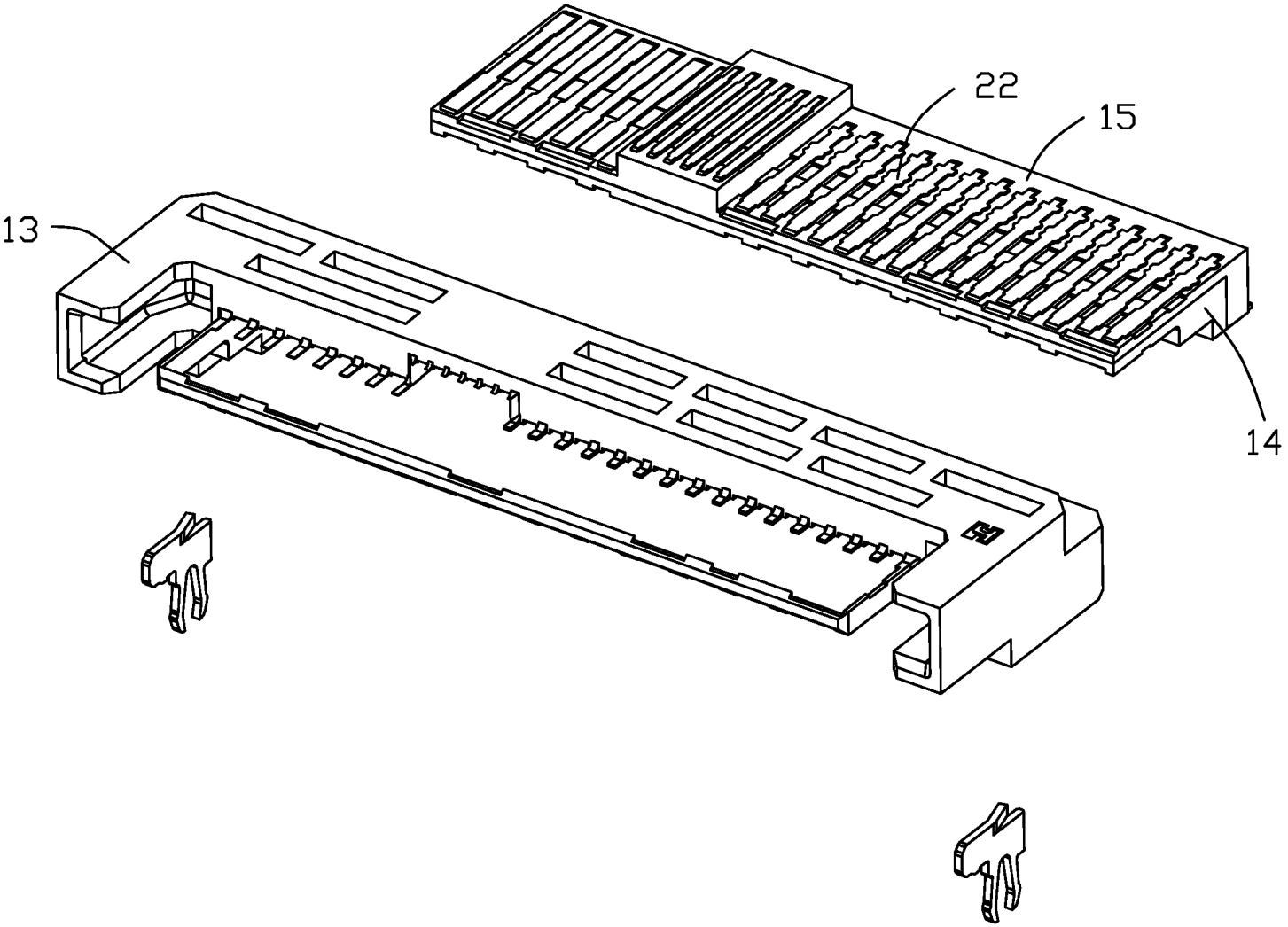
FIG. 3 is an exploded perspective view of the electrical connector of FIG. 1.
Figure 4:
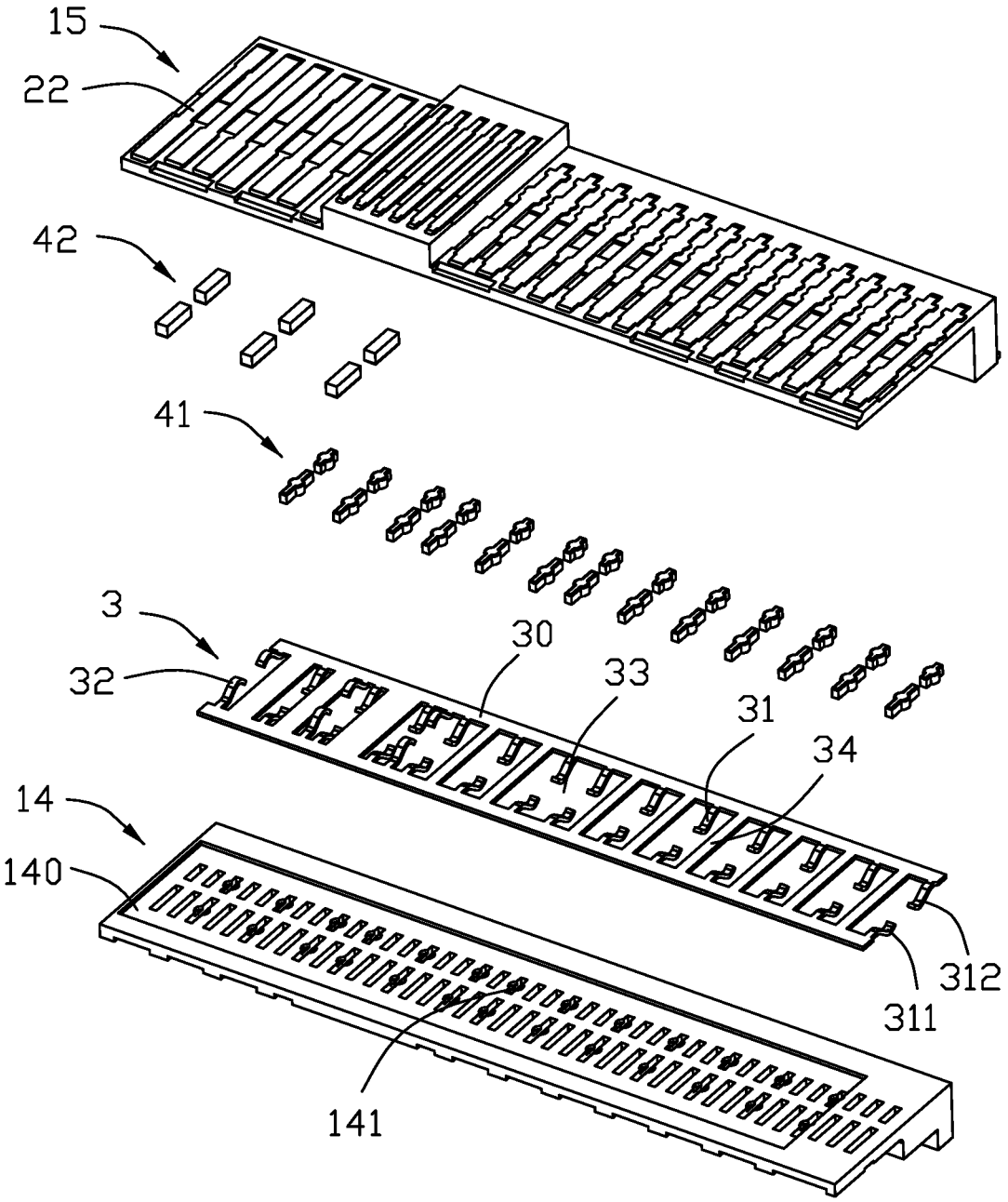
FIG. 4 is an exploded perspective view of the contact unit of the electrical connector of FIG. 3.
Figure 5:
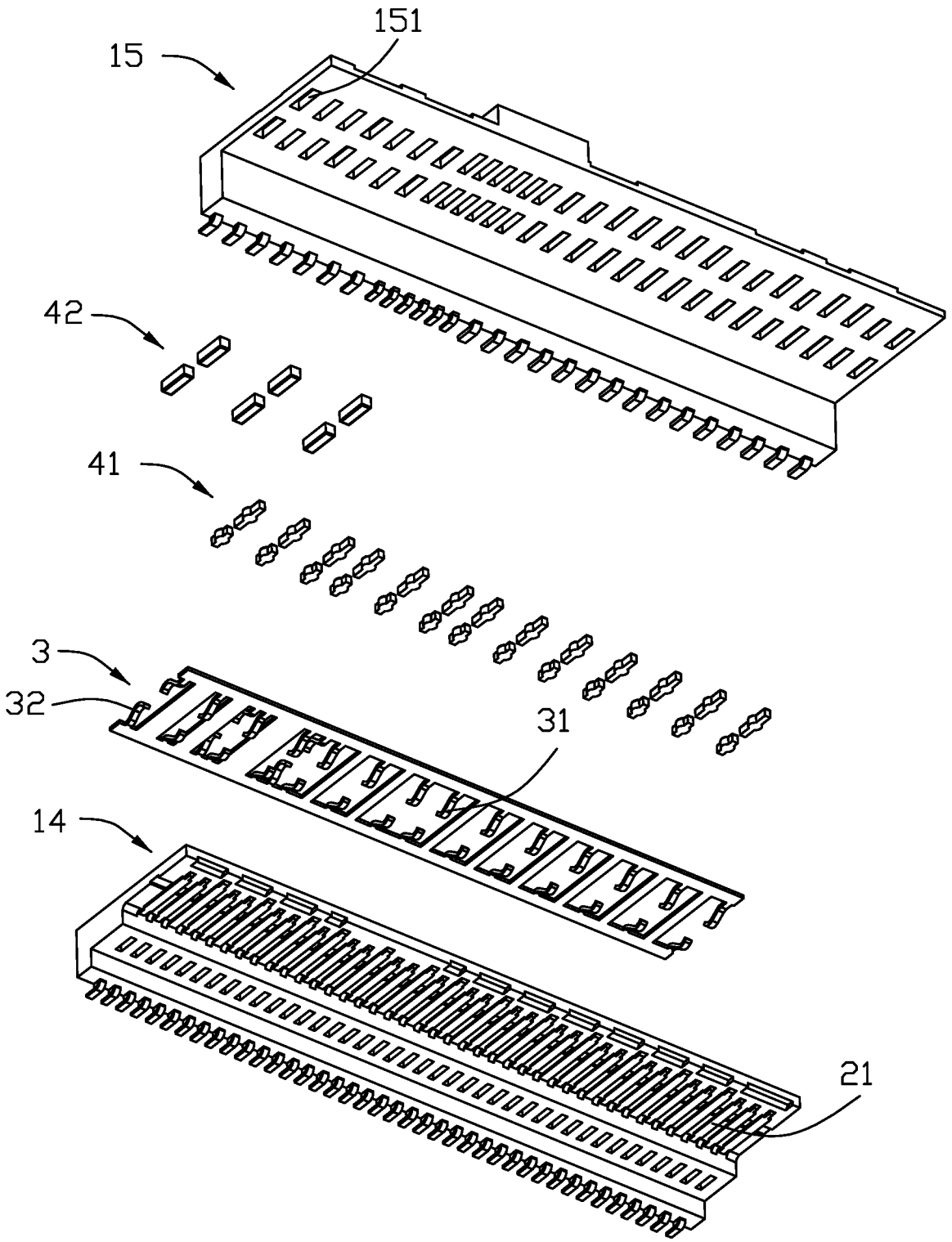
FIG. 5 is another exploded perspective view of the contact unit of FIG. 4.
Figure 6:
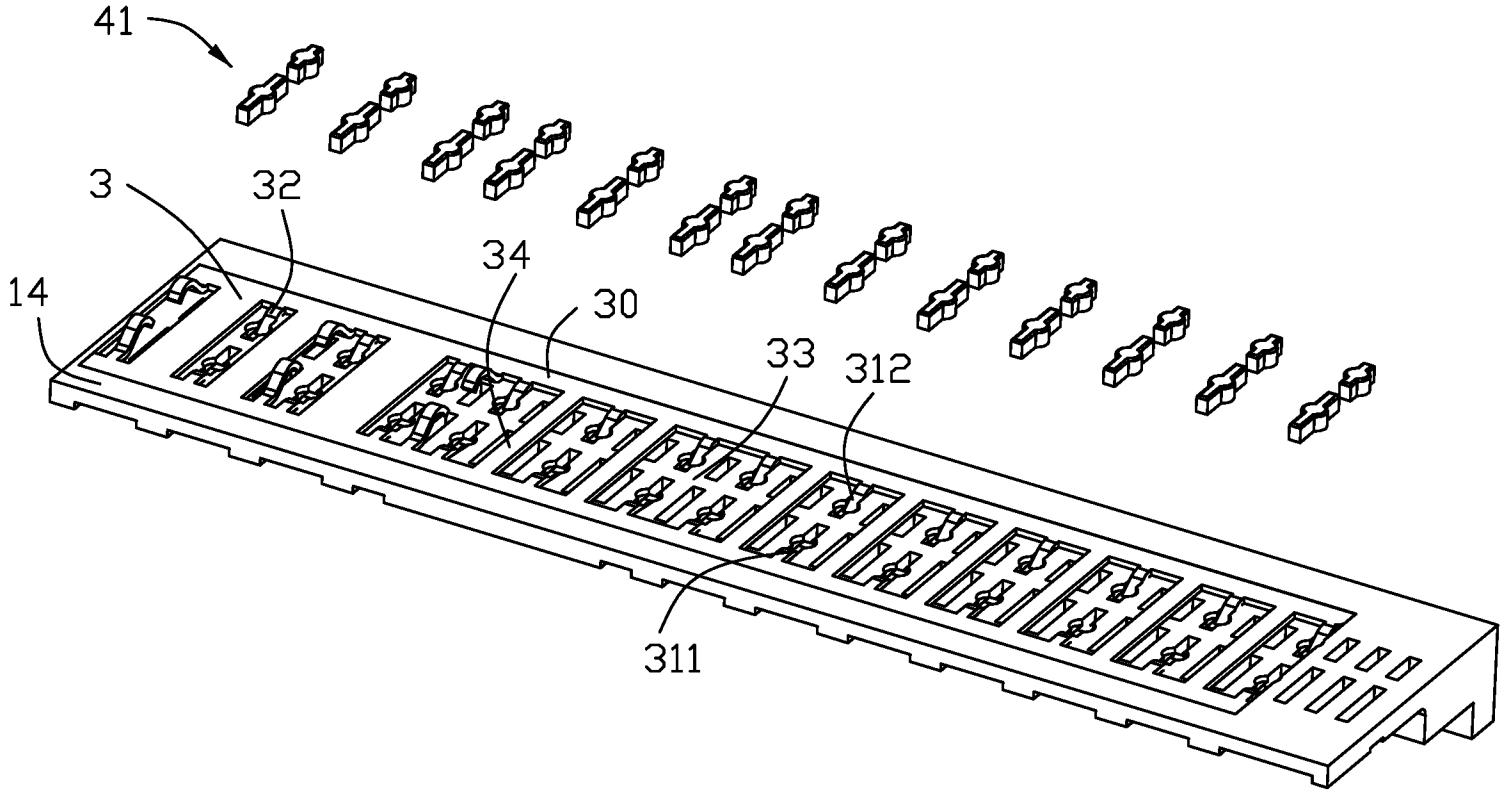
FIG. 6 is an exploded perspective view of the first insulator with the associated grounding bar and the conductive adhesive removed away from the corresponding cavities thereof of FIG. 5.
Figure 7:
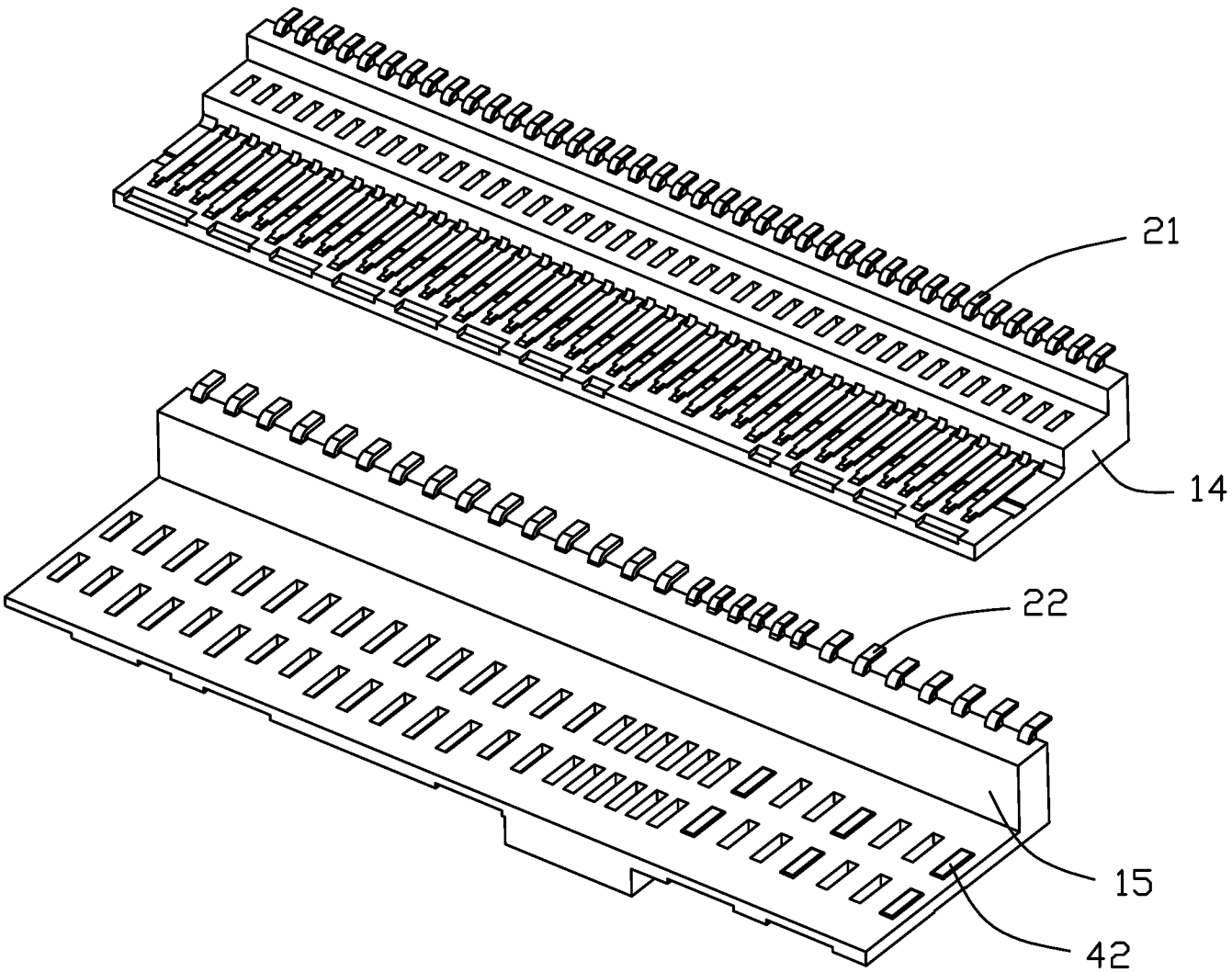
FIG. 7 is an exploded perspective view of the first insulator with the associated grounding bar and the conductive adhesive, and the second contact module of FIG. 4.
Figure 8:
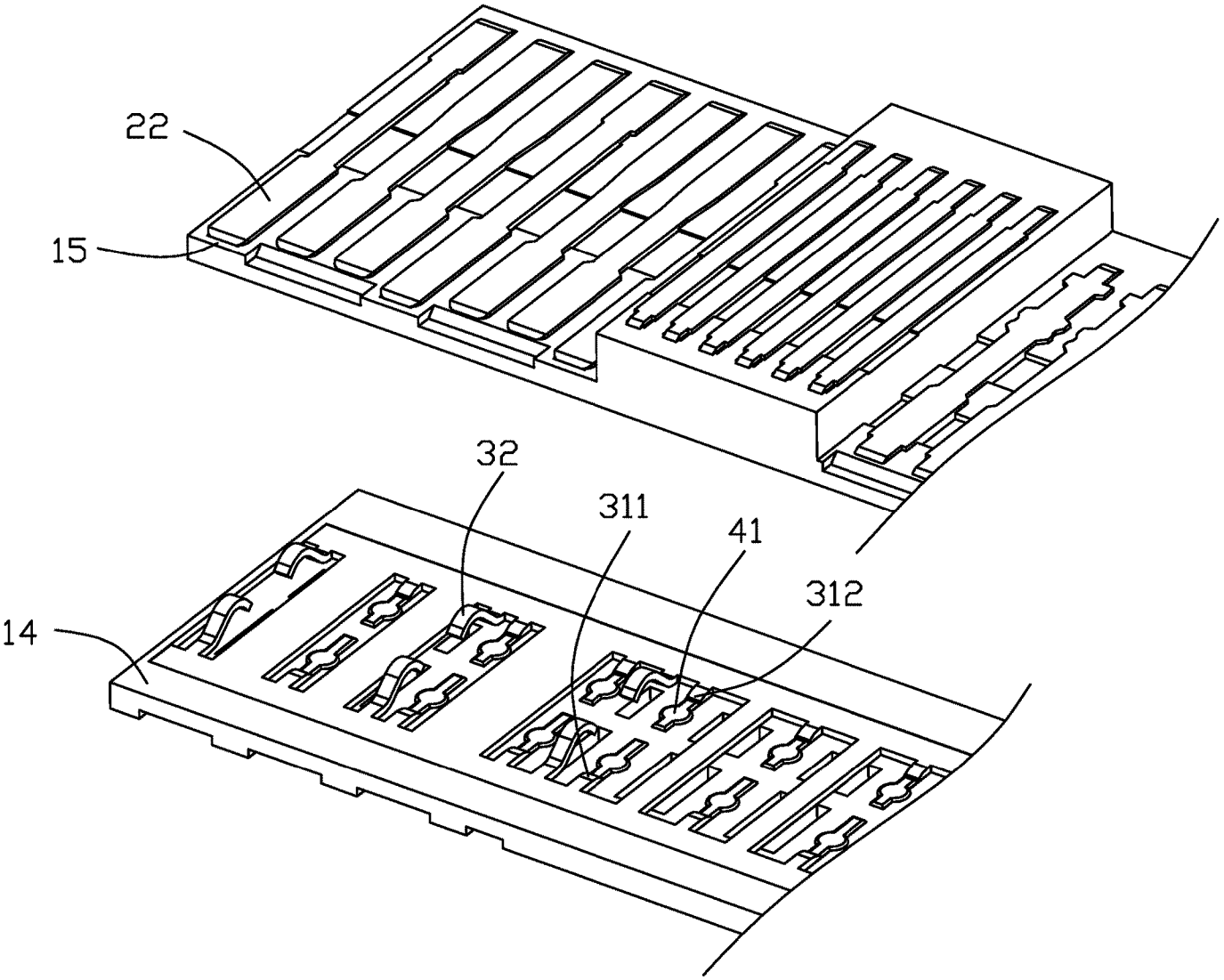
FIG. 8 is an enlarged perspective view of a portion of the contact unit of FIG. 4.
Figure 9:
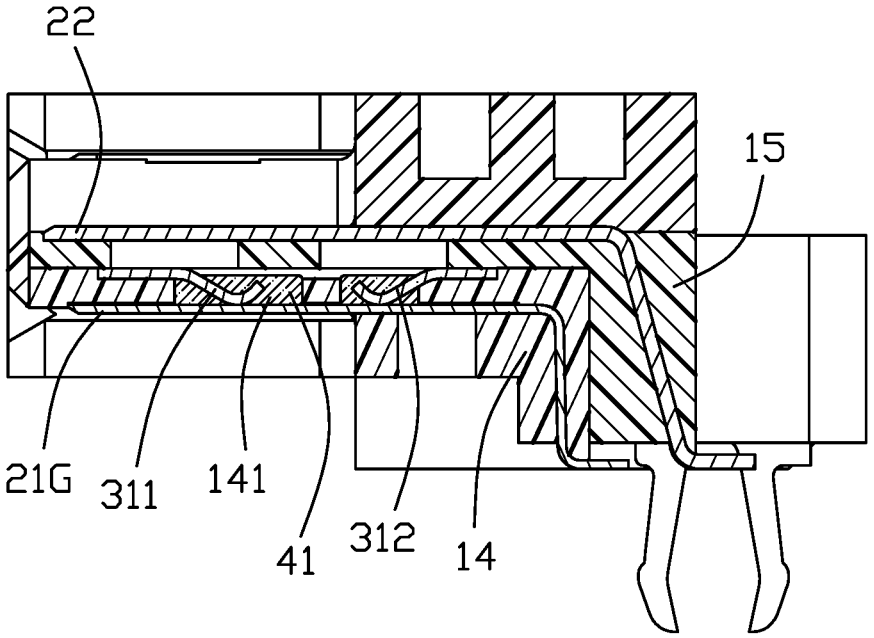
FIG. 9 is a cross-sectional view of the electrical connector of FIG. 1.
Figure 10:
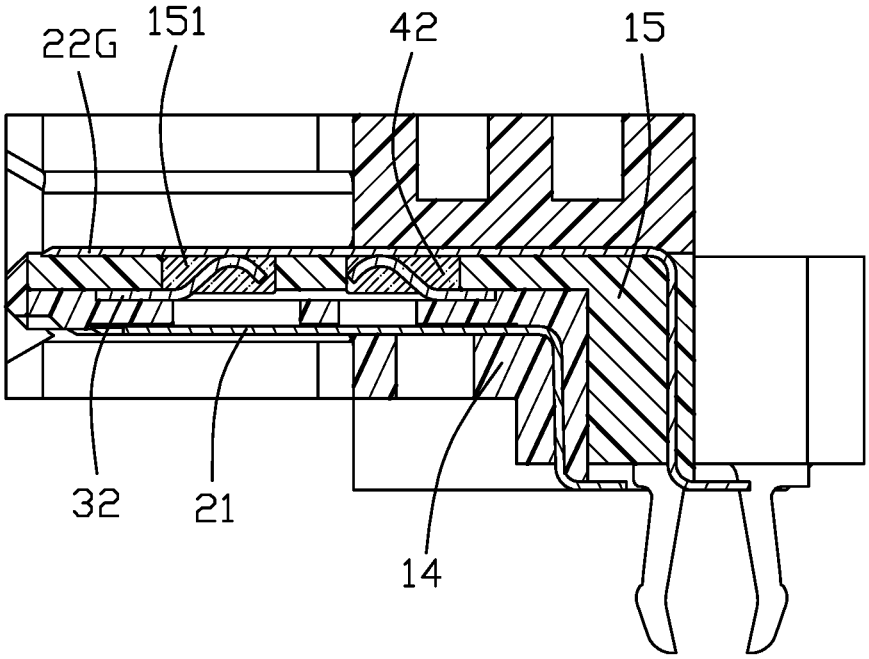
FIG. 10 is another cross-sectional view of the electrical connector of FIG. 1.

Referring to FIGS. 1-4, the insulative housing includes a base 11 and a mating tongue 12 extending from the base 11 in configuration, and structurally includes a case 13 enclosing the contact unit which is essentially consisted of the first insulator 14 of the first contact module, the second insulator 15 of the second contact module, and the grounding bar 3 therebetween. The first contacts 21 are integrally formed within the first insulator 14 to form the first contact module, and the second contacts 22 are integrally formed within the second insulator 15 to form the second contact module. The first insulator 14 forms a plurality of first cavities 141 and the second insulator 15 forms a plurality of second cavities 151. A receiving recess 140 is formed in the first insulator 14 to receive the grounding bar 3 therein.

The first contacts 21 include a plurality of signal contacts and grounding contacts 21G, and the second contacts 22 include a plurality of signal contacts and grounding contacts 22G. The contacting sections of the first contacts 21 are exposed upon the lower surface of the first insulator 14. The first cavities 141 are formed in the an upper surface of the first insulator 14. The contacting sections of the second contacts 22 are exposed upon the upper surface of the second insulator 15. The second cavities 151 are formed in a lower surface of the second insulator 15. The lower surface of the second insulator 15 and the upper surface of the first insulator 14 intimately contact each other during assembling.

The grounding bar 3 is sandwiched between the upper surface of the first insulator 14 and the lower surface of the second insulator 15, and electrically and mechanically connects to the corresponding grounding contacts 21G and 22G. The conductive adhesive fills the cavities 141 and 151 to secures the corresponding grounding contacts 21G and 22G. In detail, the grounding bar 3 includes a plurality of first spring tangs 31 extending into the corresponding first cavities 141 to contact the corresponding first grounding contacts 21G, and the second spring tangs 32 extending into the corresponding second cavities 151 to contact the corresponding second grounding contacts 22G. The first spring tang 32 includes a front spring tang 311 and a rear spring tang 312 connecting the same first grounding contact 21G wherein the front spring tang 311 is located in the mating tongue 12 and the rear spring tang 312 is located in the base 11. The grounding bar 3 further includes a pair of elongated bars 30 with a plurality crossbars 34 therebetween to form a plurality of openings 33 in which the corresponding first spring tangs 31 and the second spring tangs 32 extend. Notably, some first tangs 31 have their own openings in a one-to-one relation while each of the other first spring tangs 31 requires to share the same opening with other spring tangs.

The conductive adhesive includes a plurality of first conductive adhesive blocks 41 received within the corresponding cavities 141 to have the corresponding first spring tangs 31 electrically and mechanically connected to the corresponding first grounding contacts 21G, and a plurality of second conductive adhesive blocks 42 received within the corresponding cavities 151 to have the corresponding second spring tangs 32 electrically and mechanically connected to the corresponding second grounding contacts 22G. Notably, the first conductive adhesive block 41 and the second conductive adhesive block 42 forms bulged structures on two sides for enhancing retention.

The method of making the electrical connector 100 includes the following steps:

providing a first contact module with a plurality of first contacts integrally formed within a first insulator via a first insert-molding process, wherein the first insulator forms a plurality of first cavities to expose the corresponding first grounding contacts, respectively;

providing a second contact module with a plurality of second contacts integrally formed within a second insulator via a second insert-molding process, wherein the second insulator forms a plurality of second cavities to expose the corresponding second grounding contacts, respectively;

providing a metallic grounding bar with a plurality of first spring tangs extending into the corresponding first cavities to contact the corresponding first grounding contacts, respectively, and a plurality of second spring tangs ready to extend into the corresponding second cavities to contact the corresponding second grounding contacts, respectively;

filling and solidifying, via heating, conductive adhesive into the corresponding first cavities to form a plurality of first conductive adhesive blocks within the corresponding first cavities for securing all the first insulator, the first spring tangs and the corresponding first grounding contacts together;

filling conductive adhesive into the corresponding second cavities, stacking the first module and the second contact module together to have the second spring tangs extend into the corresponding second cavities, and solidifying conductive adhesive within the corresponding second cavities for securing all the second insulator, the second spring tangs and the corresponding second grounding contacts together; and over-molding an insulative case upon the stacked first contact module and second contact module to finalize the whole electrical connector.

Compared with the traditional designs which use either the conductive adhesive or the grounding bar for shorting all grounding contacts together, the invention uses the conductive adhesive as an auxiliary piece to assist the primary grounding bar for assuring the reliable grounding/shorting effect among all grounding contacts. In other words, the conductive adhesive not only secures the spring tang of the grounding bar to the corresponding grounding contact around the cavity but also assures the electrical conduction between therebetween. In opposite, in some traditional designs using only the discrete grounding bar, the corresponding spring tangs may not properly and strongly press the corresponding grounding contacts, thus jeopardizing the grounding/shorting effect. In addition, the conductive adhesive is unexposed and embedded within the whole contact unit, thus preventing external factors applied thereupon, including the environmental humidity or direct impacting.

What is claimed is:

1. An electrical connector comprising:

a contact unit including a plurality of contacts integrally formed within an insulator via an insert-molding process, each of said contacts extending along a front-to-back direction and including a contacting section, the contacts categorized with a plurality of differential pair contacts and a plurality of grounding contacts alternately arrange with each other along a transverse direction perpendicular to the front-to-back direction, the insulator forming opposite first and second surfaces in a vertical direction perpendicular to both the front-to-back direction and the transverse direction, the contacting section exposed upon the first surface for mating;

a plurality of cavities formed in the second surface to expose the corresponding grounding contacts, respectively;

a metallic grounding bar attached upon the second surface and including a plurality of spring tangs extending into the corresponding cavities to contact the corresponding grounding contacts, respectively; and liquid conductive adhesive applied within the corresponding cavities and successively solidified to secure the spring tangs and the corresponding grounding contacts together; wherein the conductive adhesive forms a block in each corresponding cavity, and the blocks are independent and discrete from one another without linking therebetween in the transverse direction.

2. The electrical connector as claimed in claim 1, wherein each of the spring tangs abuts against a backside of the contacting section of the corresponding grounding contact.

3. The electrical connector as claimed in claim 2, wherein the cavities are unexposed from an exterior.

4. The electrical connector as claimed in claim 1, wherein the contact unit is essentially consisted of a first contact module and a second contact module back to back stacked with each other with the contacting sections exposed oppositely toward an exterior in the vertical direction and the corresponding cavities hidden inwardly protectively.

5. The electrical connector as claimed in claim 4, wherein the grounding bar includes a pair of elongated bars extending along the transverse direction and a plurality of crossbars extending in the front-to-back direction and located between the pair of elongated bars to form a plurality of openings, and the spring tangs extend in the corresponding openings.

6. The electrical connector as claimed in claim 5, wherein some spring tangs have the corresponding opening in a one-to-one relation while remaining spring tangs share the corresponding openings with other spring tangs.

7. The electrical connector as claimed in claim 4, wherein the grounding bar includes a plurality of first spring tangs extending into the corresponding cavities in the first contact module, and a plurality of second spring tangs extending into the corresponding cavities in the second contact module opposite to the first spring tangs in the vertical direction.

8. The electrical connector as claimed in claim 1, wherein the spring tang includes along the front-to-back direction a front piece extending rearwardly to contact the contacting section of the corresponding grounding contact, and a rear piece extending forwardly to contact a retaining section of the corresponding grounding contact.

9. The electrical connector as claimed in claim 8, wherein the contact unit forms a base and a front tongue extending forwardly from the base, and the first surface is located on the front tongue for mating.

10. The electrical connector as claimed in claim 1, wherein said block forms a bulged structure on each side for enhancing retention.

11. An electrical connector comprising:

a first contact module and a second contact module assemble together, the first contact module including a plurality of first contacts integrally formed within a first insulator via a first insert-molding process and including a plurality of signal contacts and a plurality of first grounding contacts wherein the first insulator forms a plurality of first cavities to expose the corresponding first grounding contacts, respectively;

the second contact module including a plurality of second contacts integrally formed within a second insulator via a second insert-molding process and including a plurality of signal contacts and a plurality of second grounding contacts wherein the second insulator forms a plurality of second cavities to expose the corresponding second grounding contacts, respectively; and a metallic grounding bar including a plurality of first spring tangs extending into the corresponding first cavities to contact the corresponding first grounding contacts, respectively, and a plurality of second sprint tangs extending into the corresponding second cavities to contact the corresponding second grounding contacts, respectively; wherein conductive adhesive is initially filled into and further solidified within the corresponding first cavities and second cavities to not only mechanically secure the first spring tangs to the corresponding first grounding contacts and secure the second spring tangs to the corresponding second grounding contacts, but also enhance electrical transmission therebetween; wherein the conductive adhesive forms a block in each corresponding cavity, and the blocks are independent and discrete from one another without transverse linking thereamong.

12. The electrical connector as claimed in claim 11, wherein the grounding bar is sandwiched between the first contact module and the second contact module in said vertical direction, and the first spring tangs and the second spring tangs extend opposite to each other in said vertical direction.

13. The electrical connector as claimed in claim 12, wherein the first insulator defines opposite inner and outer surfaces in the vertical direction, the first cavities are formed in the inner surface of the first insulator, the second insulator defines opposite inner and outer surfaces in the vertical direction, the second cavities are formed in the inner surface of the second insulator, and the grounding bar is sandwiched between the inner surface of the first insulator and the inner surface of the second insulator in the vertical direction.

14. The electrical connector as claimed in claim 12, wherein the grounding bar includes a pair of elongated bars extending along a transverse direction perpendicular to the vertical direction, and a plurality of crossbars extending in a front-to-back direction perpendicular to both the vertical direction and the transverse direction, and located between the pair of elongated bars to form a plurality of openings, and the first spring tangs and the second spring tangs extend in the corresponding openings.

15. The electrical connector as claimed in claim 14, wherein some first spring tangs have the corresponding opening in a one-to-one relation while the remaining first spring tangs share the corresponding openings with other first spring tangs or second spring tangs.

16. The electrical connector as claimed in claim 12, wherein each of the first spring tangs includes along the front-to-back direction a front piece extending rearwardly to contact a contacting section of the corresponding first grounding contact, and a rear piece extending forwardly to contact a retaining section of the corresponding first grounding contact.

17. The electrical connector as claimed in claim 16, wherein each of the second spring tangs includes along the front-to-back direction a front piece extending rearwardly to contact a contacting section of the corresponding second grounding contact, and a rear piece extending forwardly to contact a retaining section of the corresponding second grounding contact.

18. A method of making an electrical connector, comprising steps of:

providing a contact unit with a plurality of contacts integrally formed within an insulator via a first insert-molding process, wherein the contacts include a plurality of differential pair contacts and a plurality of grounding contacts alternately arranged with each other along a transverse direction, and the insulator forms a plurality of cavities to expose the corresponding grounding contacts, respectively;

providing a metallic grounding bar with a plurality of spring tangs extending into the corresponding cavities to contact the corresponding grounding contacts, respectively;

filling and solidifying conductive adhesive into the corresponding cavities to form a plurality of conductive adhesive blocks within the corresponding cavities for mechanically securing all the insulator, the spring tangs and the corresponding grounding contacts together and electrically enhancing grounding; wherein said blocks are independent and discrete from one another without linking thereamong in the transverse direction.

19. The method as claimed in claim 18, wherein the contact unit includes a first contact module and a second contact module back-to-back stacked with each other with the corresponding cavities unexposed to an exterior.

20. The method as claimed in claim 19, wherein the spring tangs includes a first set extending into the corresponding cavities of one of said first contact module and said second contact module, and a second set extending into the corresponding cavities of the other of said first contact module and said second contact module, and the conductive adhesive is first applied into the cavities of the first contact module to secure the first set of the spring tangs to the grounding contacts of the first contact module before applied into the cavities of the second contact module to secure the second set of the spring tangs to the grounding contacts of the second contact module.

* * * * *